United States Patent [19]

Salerni et al.

[11] Patent Number: 4,541,484

[45] Date of Patent: Sep. 17, 1985

[54] COMBINATION GRAVEL PACKING DEVICE AND METHOD

[75] Inventors: John V. Salerni, Kingwood; James R. Zachman, The Woodlands, both of Tex.

[73] Assignee: Baker Oil Tools, Inc., Orange, Calif.

[21] Appl. No.: 645,271

[22] Filed: Aug. 29, 1984

[51] Int. Cl.[4] ..... E21B 34/12; E21B 43/04

[52] U.S. Cl. ..... 166/278; 166/51; 166/317; 166/325; 166/334

[58] Field of Search ..... 166/276, 278, 51, 317, 166/332, 334, 325

[56] References Cited

U.S. PATENT DOCUMENTS

| | | | |
|---|---|---|---|
| 2,751,021 | 6/1956 | Muse | 166/327 X |
| 2,998,077 | 8/1961 | Keithahn | 166/334 |
| 3,032,050 | 5/1962 | Clark, Jr. | 166/325 X |
| 4,044,832 | 8/1977 | Richard et al. | 166/278 |
| 4,103,744 | 8/1978 | Akkerman | 166/332 X |
| 4,331,315 | 5/1982 | Geisow | 166/332 X |
| 4,420,041 | 12/1983 | Patel | 166/278 |
| 4,423,773 | 1/1984 | Stout | 166/51 |

*Primary Examiner*—George A. Suchfield

*Attorney, Agent, or Firm*—Norvell & Associates

[57] ABSTRACT

An apparatus for gravel packing a screen positioned adjacent the casing perforations of a subterranean well incorporates an annular sealing surface immediately above the gravel pack screen. A flapper valve is mounted for movement about a horizontal pivot axis into engagement with the annular valve seat. The flapper valve and the cooperating valve seat are both provided with spherical segment sealing surfaces so as to prevent leakage through the valve due to any misalignment of the pivot axis of the flapper valve with respect to the annular valve seat. With this apparatus, the withdrawal of the gravel packing apparatus at the completion of the gravel packing operations prevents the entry of undesired fluids and contaminates into the producing formation.

10 Claims, 7 Drawing Figures

COMBINATION GRAVEL PACKING DEVICE AND METHOD

BACKGROUND OF THE INVENTION

1. Field of the Invention

The invention relates to an improved apparatus for gravel packing a screen and the adjoining perforated production zone of a subterranean well.

2. History of the Prior Art

Apparatus for effecting the gravel packing of a screen and the adjoining perforated production zone of a subterranean well is well known in the prior art. For example, see the 1982–1983 Catalog issued by BAKER SAND CONTROL, a Division of BAKER OIL TOOLS COMPANY of Houston, Tex. In this catalog there are disclosed typical gravel packing apparatuses and, on pages 8 and 9 of the catalog, there is described a conventional sequence for effecting the gravel packing and related operations such as squeezing and reverse flow.

In the apparatus disclosed in the aforementioned catalog, a liner assemblage is connected in depending relationship to a settable packer. The packer in turn is run into the well by a conventional setting mechanism which is connected to the bottom end of a tubular production string or work string. The tubular liner assemblage includes one or more screen which, when the apparatus is properly positioned in the well, are located adjacent the perforated production zone. The packer is then set in that position.

A gravel packing apparatus, including a conventional crossover tool, is supported in depending relationship to the packer setting mechanism and includes a wash pipe which extends downwardly through the liner assemblage and terminates at a position below or adjacent the screen. The gravel packing operation then proceeds in conventional fashion with a slurry containing the gravel being pumped down the tubular string and passed through the central bore of the set packer in the crossover tool. Below the packer seal, the gravel carrying slurry is directed outwardly through cooperating radial ports provided in the crossover tool and the adjacent portion of the liner, and flows downwardly through the annulus defined between the liner and the interior of the well casing to pile up above a sump packer or similar casing annulus sealing element or well bottom until the layer of deposited gravel covers the screen and the adjoining casing perforations. If desired, a squeezing operation can then be performed to apply pressure to the deposited gravel to force it outwardly into the perforations in the adjoining production formation. A return path for the liquid component of the gravel carrying slurry is provided by the screen and the open bottom end of the wash pipe, and this liquid component, together with any particulate matter which was small enough to pass through the screen, is flowed upwardly to the well surface through the outer passages conventionally provided in the crossover tool.

There comes a time, however, when the gravel packing and related operations are completed and the gravel packing apparatus, including the wash pipe, must be removed from the well. During this removal operation, particulate matter contained in the fluid remaining in the lower portions of the wash pipe and the crossover element of the gravel packing apparatus are free to flow downwardly into the well perforations. Also any fluids and particulates in the casing annulus above the set packer can flow into the bore of the liner assemblage and penetrate the production formation.

A principal object of this invention is to provide a reliable, automatically operating valving apparatus for effecting a complete seal of the bore area of the liner assemblage above of the screen element upon the withdrawal of the wash pipe, thus protecting the screen and the adjoining production formation from penetration by undesirable fluids and particulate matter.

SUMMARY OF THE INVENTION

This invention contemplates the provision in an otherwise conventional gravel packing apparatus of an annular valve seat located in the interior of the liner assemblage at a position above the gravel packing screen. A flapper valve is pivotally mounted to the liner assemblage for pivotal movement about a horizontal axis. During run-in and the gravel packing operation, the flapper valve is normally prevented from assuming a horizontal sealing position with respect to the annular valve seat by virtue of being trapped in a vertical position between the outer surface of the wash pipe and the adjoining inner bore of the liner assemblage. However, upon vertical movement of the wash pipe incident to the removal of the gravel packing apparatus from the well, the restraint imposed upon the flapper valve is removed and such valve pivots downwardly about its horizontal axis into engagement with the annular valve seat under the bias of a torsion spring.

The mere engagement of the flapper valve with the valve seat does not, however, solve all of the problems. It is a matter of some difficulty to effect the accurate pivotal mounting of the flapper valve so that the periphery of the valve will effect a sealing engagement around the entire periphery of the annular valve seat. To overcome this problem, the seating surface of the annular valve seat is formed as a spherical segment surface and the peripheral seating surface of the flapper valve is correspondingly formed as an annular spherical segment surface. These spherical segment surfaces are of substantially the same radius so that when the flapper valve is released to engage the valve seat, a full sealing engagement of the cooperating spherical segment surfaces will be achieved even though the pivot axis of the flapper valve may be displaced from a position in exact horizontal and vertical alignment with the annular valve seat.

Further advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENTS

Figure 1A:
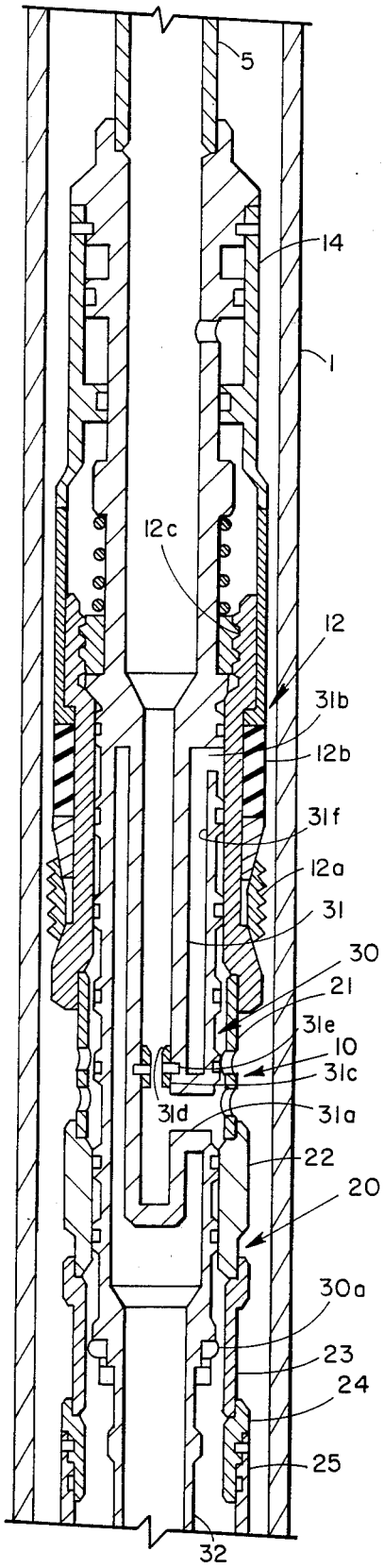
FIGS. 1A and 1B collectively represent a schematic vertical sectional view of a gravel packing and well completion apparatus embodying this invention, with the components of the apparatus shown in their run-in positions.
Figure 1B:
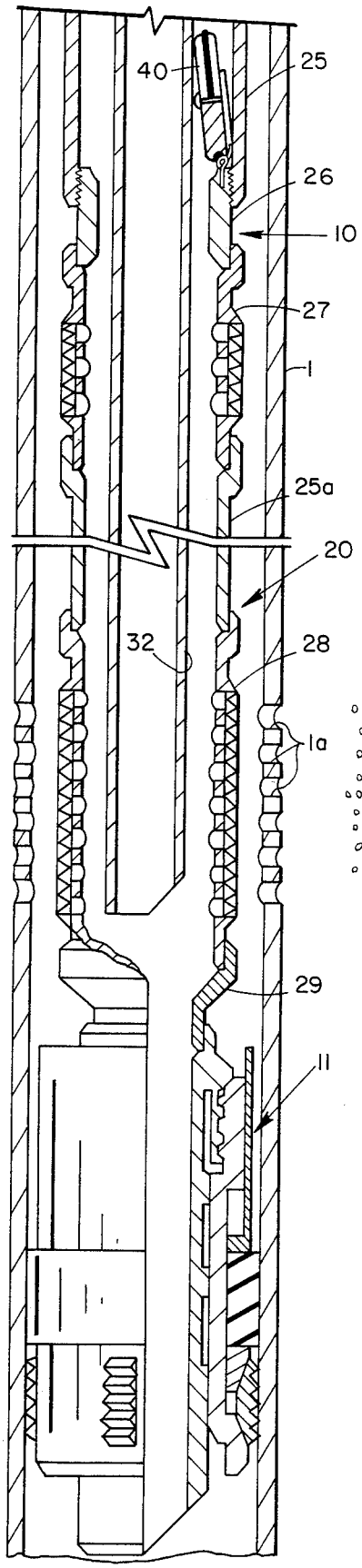

Referring to FIGS. 1A and 1B, there is shown a combined well completion and gravel packing apparatus 10 shown in inserted relationship within the well casing 1, having a plurality of perforations 1*a* disposed in vertically spaced relationship adjacent a production formation. Prior to insertion of the apparatus 10, a sump packer 11 may be installed by wireline at a position below the perforations 1*a*.

The well completion apparatus includes a settable packer 12 which is carried into the well by a conventional hydraulic packer setting mechanism 14 which in turn is run into the well on the bottom end of a tubular work string 5.

Packer 12 is threadably and sealably secured to the top end of a liner assemblage 20 which includes, in descending order, a ported liner element 21, a seal bore sub 22, a lower extension sub 23, a shear-out safety mechanism 24, a space-out blank pipe 25, a valve seat sub 26, a tell-tale screen 27, a second space-out blank pipe 25*a*, a gravel pack screen 28, and a snap latch seal assembly 29 for effecting a sealing engagement with the sump packer 11. Except for the valve seat sub 26, all of the aforedescribed elements of the liner assemblage 20 are conventional and are illustrated in the aforementioned pages 8 and 9 of the BAKER SAND CONTROL CATALOG. Accordingly, further detailed description of the conventional elements is unnecessary.

Figure 2A:
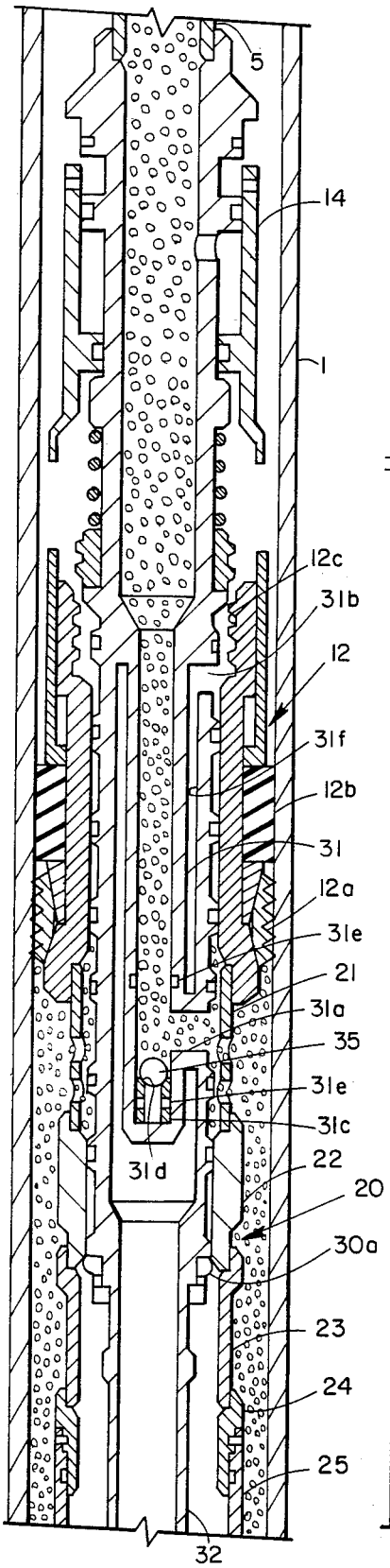
FIGS. 2A and 2B are views respectively similar to FIGS. 1A and 1B but represent the positions of the components of the apparatus during the actual gravel packing operation.

Additionally, a conventional gravel packing tool assemblage 30 is supported in depending relationship from the packer setting tool 14 and projects downwardly into the bore of the liner assemblage 20. The gravel packing tool assemblage comprises a conventional crossover tool 31 having the usual ported passages 31*a* and 31*b* respectively at its lower and upper ends to provide communication with the casing annulus respectively below and above the set packer 12, as illustrated in FIG. 2A. Lastly, a wash pipe 32 is secured to the bottom end of the crossover tool 31 and projects downwardly through the bore of the liner assemblage 20 terminating at a position adjacent the bottom end of the gravel packing screen 28. Again, all of this portion of the gravel packing apparatus is conventional and is described and illustrated on pages 8 and 9 of the aforementioned catalog.

The entire apparatus 10 is lowered into the well by tubular work string 5 with the elements thereof disposed in the positions illustrated in FIGS. 1A and 1B. The snap latch seal assembly 29 is engaged with the sump packer which positions the gravel pack screen 28 immediately adjacent the casing perforations 1*a*.

A ball 35 (FIG. 2A) is then dropped through the tubular work string 5 to seat upon an annular seating surface 31*d* provided on a disposable valve sleeve 31*c* mounted within the central bore of the crossover tool 31 by and secured by shear pins 31*e*. Fluid pressure is then built up within the tubular work string 5 sufficient to effect the operation of the hydraulic setting tool 14 to effect the expansion of the slips 12*a* and the elastomeric seal element 12*b* of the settable packer 12 into engagement with the bore of the casing 1, as illustrated in FIG. 2A. Following the setting of the packer 12, the setting tool 14 is released from the packer by right hand rotation of the tubular work string, thus effecting separation of the setting tool from the left hand threads 12*c* conventionally provided in the packer 12. The gravel packing apparatus 30 is then elevated until an indicating ring 30*a* contacts the bottom end of the seal bore sub 22, at which position the various external seals provided on the crossover tool 31 are properly positioned with respect to ports in the liner assemblages 20 to effect the gravel packing operation in conventional fashion. The disposable valve sleeve 31*c* is forced downwardly by increasing the fluid pressure in work string 5 sufficient to shear pins 31*e*.

Figure 2B:
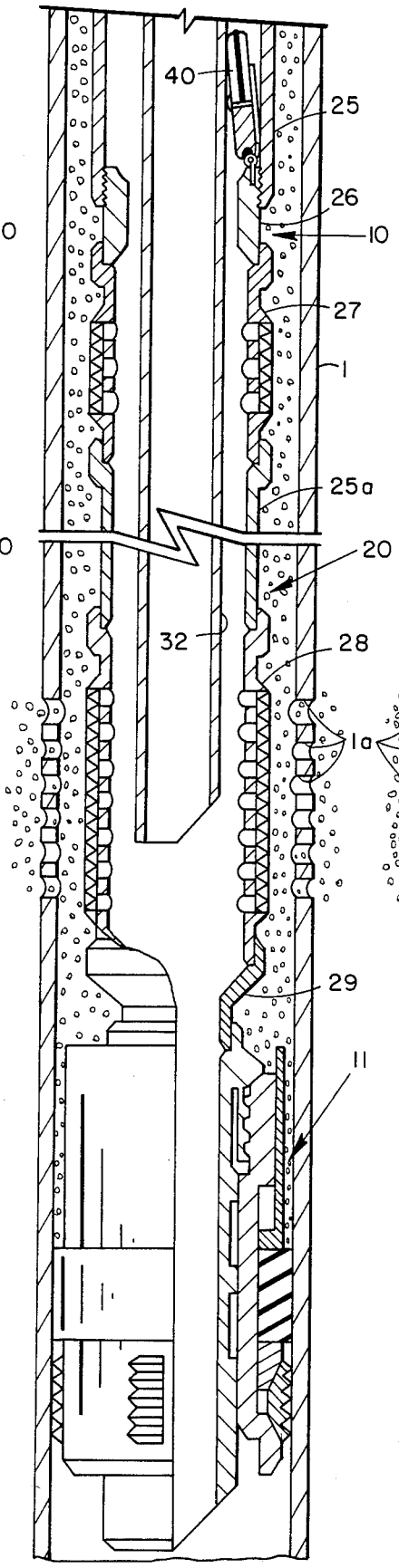

As illustrated in FIGS. 2A and 2B, a slurry containing gravel is then pumped downwardly through the work string 5 and flows outwardly through the lower port 31*a* provided in the crossover tool 31 and thence through the ported sleeve 21 into the annulus defined between the liner assemblage 20 and the bore of the casing 1. The gravel contained in the slurry is thus permitted to build up in the casing annulus above the sump packer 11 so that the gravel pack screen 28 is covered by the deposited gravel. The liquid component of the gravel slurry is returned upwardly to the well surface by passing through the gravel pack screen 28 and entering the open bottom end of the wash pipe 32. The liquid component passes upwardly through the outer axial passages 31*f* provided in the crossover tool 31 and exits into the casing annulus through the upper radial crossover port 31*b* at a point above the annulus seal provided by seal element 12*b* of the set packer 12. The gravel packing operation is continued until the accumulated gravel covers the tell-tale screen 27, which results in a pressure indication to the operator at the surface that sufficient gravel has been deposited to insure that the gravel pack screen 28 and the casing perforations 1*a* have been covered with deosited gravel.

At this point, a squeezing operation can be performed in the manner indicated on page 8 of the aforementioned BAKER SAND CONTROL catalog.

When the gravel packing operation has been completed, the customary procedure is to remove the tubular work string 5 from the well and thus carry the gravel packing apparatus 30 out of its cooperating relationship with the liner assemblage 20. Thus obviously permits fluids and particulates contained in the gravel pack apparatus 30, as well as in the casing annulus above the packer 12, to flow downwardly into the bore of the liner assemblage 20 and thus pass through the gravel packing screen 28 and enter the production formation through the casing perforations 1*a*.

Figure 4:
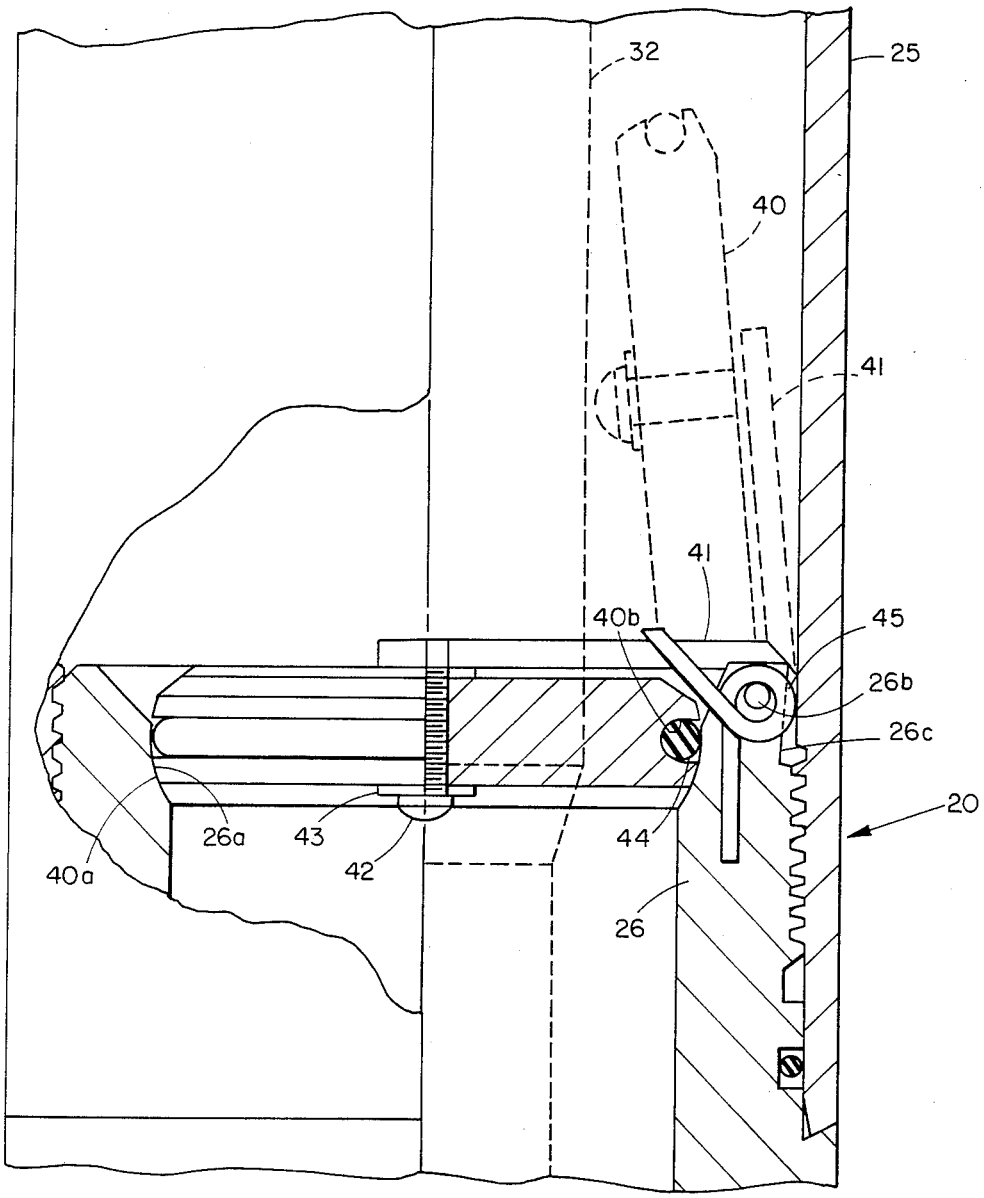
FIG. 4 is an enlarged scale, partial sectional view of a portion of FIG. 3B illustrating the construction of the flapper valve.

In accordance with this invention, such deleterious flow of undesired fluids and contaminates is prevented through the incorporation in the liner assemblage of a valve seat sub 26. As best shown in FIG. 4, valve seat sub 26 defines at its upper end an annular valve seat 26*a* having a spherical segment shaped cross-sectional configuration. Additionally, valve seat sub 26 is provided with a recess 26*c* which is traversed by a horizontal pivot pin 26*b* for effecting the horizontal pivotal mounting of a flapper valve arm 41. A flapper valve body 40 is secured to the outer end of the mounting arm 41 by a bolt 42. A seal washer 43 underlies the head of bolt 42. The outer perimeter 40*a* of the flapper valve body 40 is formed as a spherical segment shaped surface having a radius closely approximating but less than that of the spherical segment shaped valve seat 26*a*. The upper portion of the perimeter of the flapper valve body 40 is provided with an annular recess 40*b* to accomodate an O-ring 44 which also sealingly engages the spherical segment shaped sealing surface 26*a*.

Figure 3A:
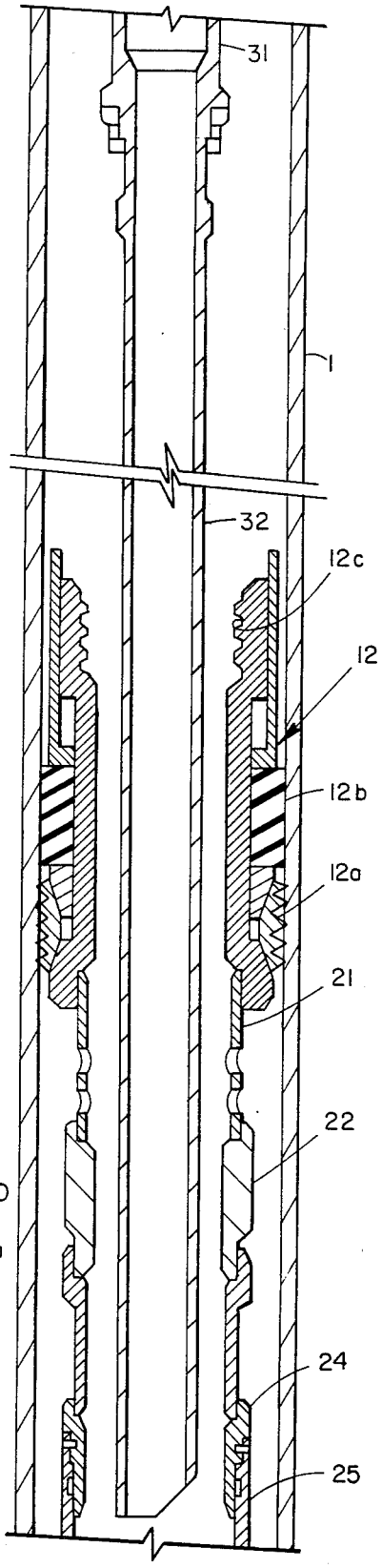
FIGS. 3A and 3B are views respectively similar to FIGS. 2A and 2B but illustrate the position of the components of the gravel packing apparatus after completion of the gravel pack and during removal of the gravel packing apparatus from the well.
Figure 3B:
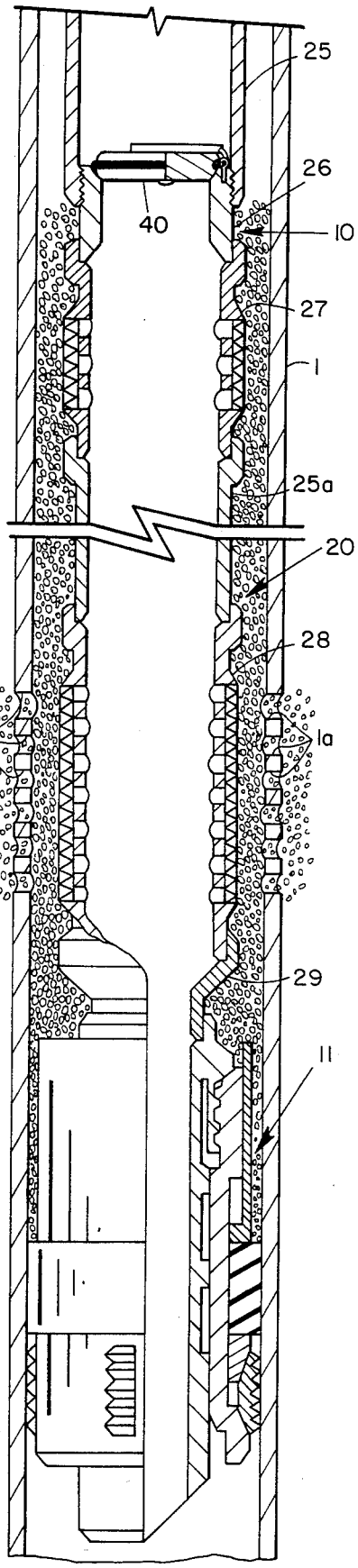

In accordance with this invention, during the run-in, gravel packing and related operations, the flapper valve body 40 is trapped in a substantially vertical position as indicated by the dotted lines in FIG. 4 between the outer wall of the wash pipe 32 and the inner bore of the blank pipe 25. Thus, the flapper valve does not in any manner interfere with the run-in or gravel pack operations. However, when the gravel pack is completed and the gravel packing apparatus 30, including the wash pipe 32, is moved upwardly for withdrawal from the well by the tubular string 5, as indicated in FIGS. 3A and 3B, the flapper valve body 40 is freed to move downwardly into sealing engagement with the spherical segment shaped sealing surface 26*a*. A torsion spring 45 mounted between the valve support arm 41 and the valve seat sub 26 assists in urging the flapper valve body 40 into its sealed engagement with the valve seat 26*a*.

It is thereby assured that no significant quantities of undesired contaminates or well fluids will be permitted to enter the bore of the liner assemblage 20 during the removal of the gravel packing apparatus 30 from the well. Moreover, a perfect seal is assured for flapper valve 40 by virtue of the utilization of cooperating spherical segment surfaces as the sealing members. It is therefore unnecessary that the horizontal pivot axis of the support arm 41 be precisely aligned with the axis of the annular valve seat 26*a*, inasmuch as the spherical configuration of the cooperating sealing surfaces will compensate for a substantial misalignment of such pivot axis from the correct position.

If desired, the flapper valve body 40 may be formed from a glass or other frangible ceramic material so that it may be readily broken and the fragments thereof dropped down into the well rat hole whenever it is desired to open the passage through the bore of the liner assemblage 20 for production purposes.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A gravel packing apparatus for the perforated zone of a subterranean well comprising, in combination: a packer; a tubular assembly depending from said packer including a screening means; packer setting means detachably associated with said packer and constructed and arranged to be run into the well by a tubular string, whereby said packer may be positioned and set with said screening means opposite the perforated zone; a gravel packing assembly depending from said packer setting means and including a crossover tool, normally extending through said screening means; means in said tubular assembly defining a generally horizontal, annular spherical segment shaped valve seat located above said screening means; a flapper valve member horizontally pivotal to said tubular assembly and having a periphery defining a spherical segment surface cooperable with said valve seat in sealing relation thereto; said crossover tool normally holding said flapper valve member in a generally vertical position out of contact with said valve seat; and resilient means urging said flapper valve toward engagement with said valve seat, whereby withdrawal of said packer setting means and said gravel packing assembly permits said flapper valve member to move into sealing engagement with said valve seat.

2. The apparatus of claim 1 wherein one of said spherical segment surfaces mounts an elastomeric sealing element.

3. The apparatus of claim 1 wherein said flapper valve member comprises a frangible mass, the periphery of said frangible mass being ground to define an annular spherical segment surface sealingly engagable with said valve seat irrespective of minor misalignment of the horizontal pivot axis of said flapper valve member relative to said valve seat.

4. The apparatus of claim 3 wherein said spherical segment surface on said frangible mass mounts an elastomeric sealing means.

5. The method of gravel packing a perforated zone of a subterranean well, comprising the steps of:

1. communicating with a settable annular packer, a depending tubular assembly including a screen means, an annular spherical segment shaped valve seat concentrically disposed above said screen means and a circular flapper valve member having a spherical segment shaped periphery horizontally pivotally mounted in said tubular assembly and spring biased to move into sealing engagement with the valve seat;
2. communicating a gravel packing apparatus with a packer setting mechanism and detachably securing the packer setting mechanism to the settable packer with a member of said gravel packing apparatus extending through said valve seat and maintaining said flapper valve member in a substantially vertical, inoperative position;
3. running all of the aforesaid apparatus into the well on a tubular string to position said screen means adjacent the perforated zone;
4. setting the packer by the setting mechanism;
5. packing the perforated zone with gravel conveyed as a liquid slurry to the gravel packing apparatus through the tubular string for deposit around said screen means with the liquid component of the slurry being returned to the surface; and
6. withdrawing the packer setting mechanism and the gravel packing apparatus from the well, thereby permitting said flapper valve member to move into sealing engagement with said valve seat to prevent entry of fluids or contaminates into the perforated zone during and after removal of the gravel packing apparatus.

6. A gravel packing apparatus for the perforated zone of a subterranean well comprising, in combination: a packer; a tubular assembly depending from said packer including a screening means; packer setting means detachably associated with said packer and constructed and arranged to be run into the well by a tubular string, whereby said packer may be positioned and set with said screening means opposite the perforated zone; a gravel packing assembly depending from said packer setting means and including a crossover tool, and a depending wash pipe normally extending through said screening means; means in said tubular assembly defining a generally horizontal, annular spherical segment shaped valve seat located above said screening means; a flapper valve member horizontally pivotal to said tubular assembly and having a periphery defining a spherical segment surface cooperable with said valve seat in sealing relation; said wash pipe normally holding said flapper valve member in a generally vertical position out of contact with said valve seat; and resilient means urging said flapper valve toward engagement with said valve seat, whereby withdrawal of said packer setting means and said gravel packing assembly permits said flapper valve member to move into sealing engagement with said valve seat.

7. The apparatus of claim 6 wherein one of said spherical segment surfaces mounts an elastomeric sealing element.

8. The apparatus of claim 6 wherein said flapper valve member comprises a frangible mass, the periphery of said frangible mass being ground to define an annular spherical segment surface sealingly engagable with said valve seat irrespective of minor misalignment of the horizontal pivot axis of said flapper valve member relative to said valve seat.

9. The apparatus of claim 8 wherein said spherical segment surface on said frangible mass mounts an elastomeric sealing means.

10. The method of gravel packing a perforated zone of a subterranean well, comprising the steps of:

1. communicating with a settable annular packer, a depending tubular assembly including a screen means, an annular spherical segment shaped valve seat concentrically disposed above said screen means and a circular flapper valve member having a spherical segment shaped periphery horizontally pivotally mounted in said tubular assembly and spring biased to move into sealing engagement with the valve seat;
2. communicating a gravel packing apparatus including a depending wash pipe with a packer setting mechanism and detachably securing the packer setting mechanism to the settable packer with a member of said wash pipe extending through said valve seat and maintaining said flapper valve member in a substantially vertical, inoperative position;
3. running all of the aforesaid apparatus into the well on a tubular string to position said screen means adjacent the perforated zone;
4. setting the packer by the setting mechanism;
5. packing the perforated zone with gravel conveyed as a liquid slurry to the gravel packing apparatus through the tubular string for deposit around said screen means with the liquid component of the slurry being returned to the surface; and
6. withdrawing the packer setting mechanism and connected wash pipe from the well, thereby permitting said flapper valve member to move into sealing engagement with said valve seat to prevent entry of fluids or contaminates into the perforated zone during and after removal of the gravel packing apparatus.

* * * * *